United States Patent [19]

Edwards

[11] Patent Number: 4,600,024

[45] Date of Patent: Jul. 15, 1986

[54] TOBACCO SEPARATION PRETREATMENT SYSTEM

[76] Inventor: Leon Edwards, 5724 Forrest Ave., Richmond, Va. 23225

[21] Appl. No.: 504,406

[22] Filed: Jun. 15, 1983

[51] Int. Cl.[4] ..... A24B 15/22

[52] U.S. Cl. ..... 131/299; 131/327

[58] Field of Search ..... 131/290, 294, 295, 299, 131/327, 108, 109 AB; 34/1

[56] References Cited

U.S. PATENT DOCUMENTS 3,494,723 2/1970 Gray ..... 131/299

3,828,797 8/1974 Neumann et al. ..... 131/294

OTHER PUBLICATIONS

Hirose et al.; Micro. Heat. of Multi-Lay. Cig.; J. of Micro. Power. 13(2); 1978; pp. 125-129.

Hirose et al.; Use. of Micro. Heat. to Cont. Insects in Cig. Manag., J. of Micro. Power; 10(2); 1975; pp. 181-190.

*Primary Examiner*—Millin V.

*Assistant Examiner*—Gregory Beaucage

[57] ABSTRACT

Packed tobacco leaves are pretreated by microwave generators with control sensors preliminary to separation.

6 Claims, 2 Drawing Figures

TOBACCO SEPARATION PRETREATMENT SYSTEM

BACKGROUND OF THE INVENTION

Whole leaf and strip tobacco is commonly packed in hogsheads, cases, bales, or burlap sheets, and stored for an extended period before further processing. When the time comes for further processing, it is necessary to prepare the leaves for ready separation in conventional equipment, such as an air classifier, and this is customarily done by placing one or more of the packs of leaves in a vacuum chamber and permeating them with steam, such as by means of a sharp probe to inject the steam between layers of the leaves. As a practical matter, the use of a vacuum means that this method of separation has to be carried out on a batch basis and hence is limited in speed and efficiency compared to a continuous process. Moreover, some parts of the packed leaves are so much more dense and resistent to separation than others that localized parts of the pack remain unseparated. Such unseparated segments resist subsequent operations and thus cause difficulties in subsequent stages of operation.

SUMMARY OF THE INVENTION

The present invention provides a more effective and efficient apparatus and process for separating packed tobacco leaves, by replacing the conventional vacuum chamber and steam injectors with a series of microwave generators operating on a succession of bales and other forms of packs of the leaves travelling on a conveyor past microwave generator stations. One set of sensors, which may be photo-electric cells, are positioned to detect the presence of tobacco on the conveyor adjacent each microwave generator position, with connections to turn down or deactivate a microwave generator when there is no tobacco on the conveyor near that generator. A second set of sensors, which may be responsive to infrared radiation, are arranged adjacent at least the final series of microwave generators, with connections to raise the power output of each of these microwave generators when the tobacco on the conveyor adjacent that generator is below a predetermined temperature (such as 140° F.), and to turn down the power output of that microwave generator if the temperature of the tobacco on the conveyor adjacent that generator is above a predetermined limit (such as 165° F.). The particular upper and lower temperature limits to which the heat sensors are set is selected with a view to avoid raising the temperature of tobacco to a value which would cause it to puff or otherwise injure it, but to raise it to a sufficiently high value to put the tobacco in a condition where the leaves readily separate.

Tobacco leaves or parts of leaves treated in accordance with the invention become limp and readily separable. This effect extends even to the denser portions of the packed leaves, which would otherwise resist separation, and applies to all customary sizes of packs of tobacco leaves, from the small bales in which Turkish tobacco, for example, is usually packed, to the much larger tersabales and hogsheads of U.S. tobacco. However, in order to reduce the expense of buying particularly large microwave generating units, it may be desirable to pull apart the largest units into a pair of smaller pieces before putting them through the microwave generator treatment.

BRIEF DESCRIPTION OF THE DRAWING

The accompanying drawing schematically illustrates a presently preferred form of apparatus for practicing the invention, as follows.

DETAILED DESCRIPTION OF THE PRESENT PREFERRED EMBODIMENT

Figure 2:
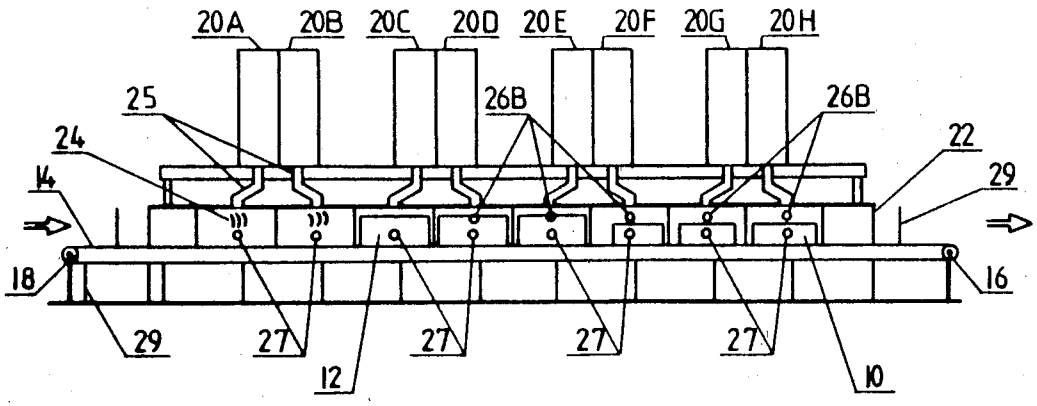
FIG. 2 shows a section on the line II—II in FIG. 1.
Figure 1:
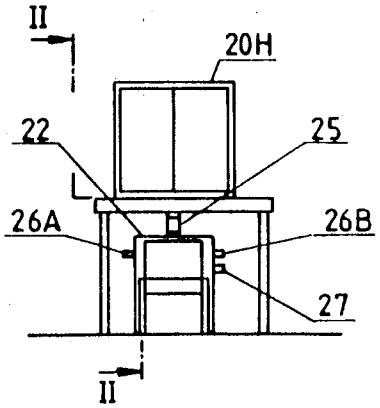
FIG. 1 is an end view of the apparatus.

Referring now more particularly to the accompanying drawing, there is shown a series of small packs or bales 10 of tobacco leaf followed by a series of larger packs or bales 12 of tobacco leaf, all on the upper flight of a supporting means here shown as a conveyor belt 14 moving to the right as seen in the FIG. 2. The belt 14 is of flexible material capable of reflecting microwaves, such as polished stainless steel, and is trained around a drive roller 16 and idler roller 18.

A series of adjustable microwave generators 20A to 20H are mounted along the top of a treating chamber 22, and are arranged to project microwaves 24 through wave guide outlets 25 at the top of the chamber toward the bales passing beneath them. A series of pairs of temperature monitoring infrared sensors 26A and 26B are mounted in chamber 22, the sensors 26A being positioned on one side and the sensors 26B being positioned on the opposite side of the bales passing through the chamber. One pair of the infrared sensors 26A and 26B is positioned beneath the final generator 20H, and the other pairs are positioned respectively beneath the preceding microwave generators 20D to 20G. Each of these infrared sensors is connected to turn down the power of the microwave generator above it to a low enough level to avoid significant overheating of the bale opposite the sensor (rather than turning the gernerator entirely off, in order to extend the life of the generator), if the sensed temperature of the opposite bale is above a predetermined level such that further heating of the bale might be harmful to it. Such an upper level would be, for example, at about 150° F. On the other hand, if the sensed temperature of the bale is below a lower predetermined level, such that the tobacco would not be given enough microwave energy to accomplish the desired condition of ready separation, the sensor would turn up the power of the microwave generator above it, if the generator is not already at that level of power output. Such lower predetermined limit would usually be set at about 140° F. Between these levels there is enough melting of the resins in all the leaves to achieve the desired effect of achieving readiness for subsequent separation.

Beneath each of the microwave generators 20A to 20H there is also provided a photoelectric cell sensor 27 which is connected to largely turn down if not entirely deactivate the microwave generator above it whenever the sensor 27 senses no pack of tobacco on the conveyor 14 beneath the adjacent microwave generator. The photoelectric sensors 27 are arranged to override any contrary signal from the infrared sensors.

It is preferable to send bales through having height variations of no more than about 1½ inches. If more than one size of bale is to go through the apparatus, outside of this limit of variation, it is preferable to send the series of bales within the size limit variation through together, and then to shift to a similarly uniform series of bales of a different average height, in order to avoid undesirable fluctuations of action of the microwave generators on the bales.

A series of rectangular panels 29 are mounted to travel with belt 14 and to project upwardly from the upper flight of the belt while passing through chamber 22. The tobacco bales are disposed on the belt between the panels. The top and side walls of chamber 22 closely fit against the panels 29 passing between them, the spacing between panels 29 corresponds to the substantially equal spacing between the wave guide outlets 25 into the top of chamber 22, and the length of chamber 22 from each of its entrance and exit ends to the outlet 25 nearest to that end is greater than the length of the longest spacing between any pair of adjacent panels 29. In this way, since the materials of panels 29 and the walls of chamber 22 are selected to resist penetration by microwaves, the escape of microwaves from the chamber is prevented.

The microwave generators have enough power to cause the microwaves to penetrate entirely through the largest unit to be treated in the apparatus, with some reflectance back of a minority of the incoming waves whose energy has not been absorbed on the way to the top surface of the conveyor belt 14. For example, the chamber 22 may have an effective internal length of about 37.5 feet (for example, a Model #CCO 160 of Cobra Electronics, Inc.), with six to eight magnetron microwave generators each of 50 KW output (for example, I.E. RCA Model C-94600 E). The rate of travel through this apparatus may be set at eight feet per minute to produce a dwell time for each bale in the chamber of a little less than five minutes, and a treatment rate of 15,000 pounds per hour on a belt three feet wide.

While methods and apparatus for practicing the invention have been illustrated and described, it will be understood that the invention is not limited thereto, but rather by the scope of the following claims.

I claim:

1. A method of reducing the force with which the constituents of bales or other types of packs of compacted tobacco leaves and/or unshredded parts of tobacco leaves adhere to each other, comprising the step of subjecting the packs to the action of microwaves.

2. The mehtod of claim 1, further comprising the step of conveying packs along a predetermined path, said subjecting step including establishing at least one source of microwaves and directing microwaves from such source into at least one portion of said path.

3. The method of claim 1, wherein the packs are heated as a result of exposure to microwaves and further comprising the steps of monitoring the temperature of heated packs and regulating the power of the microwaves so as to maintain the temperature of heated packs within a predetermined range.

4. The method of claim 1, wherein said subjecting step includes passing microwaves through the entire packs.

5. The method of claim 1, wherein said subjecting step includes repeatedly subjecting each pack to the action of microwaves.

6. The method of claim 1, wherein the tobacco leaves and parts of tobacco leaves contain resins which melt in response to heating, said subjecting step including heating the packs to a temperature high enough to effect melting of the resins in at least the majority of leaves and/or parts of leaves.

* * * * *

UNITED STATES PATENT AND TRADEMARK OFFICE

CERTIFICATE OF CORRECTION

PATENT NO. : 4,600,024

DATED : July 15, 1986

INVENTOR(S) : Leon Edwards

It is certified that error appears in the above-identified patent and that said Letters Patent is hereby corrected as shown below:

Title page:

[73] Assignee: Hallmark Fabricators, Inc., Richmond, Va.---.

Signed and Sealed this

Tenth Day of March, 1987

*Attest:*

*Attesting Officer*

DONALD J. QUIGG

*Commissioner of Patents and Trademarks*